US005249109A

United States Patent [19]

Denison et al.

[11] Patent Number: 5,249,109

[45] Date of Patent: Sep. 28, 1993

[54] OUTDOOR VARIABLE FOCUS LIGHT FIXTURE

[75] Inventors: John F. Denison, Lake Villa; John A. Czerlanis, Solon Mills, both of Ill.; Ronald L. Sitzema, Ellsworth, Mich.

[73] Assignee: Intermatic Incorporated, Spring Grove, Ill.

[21] Appl. No.: 742,744

[22] Filed: Aug. 9, 1991

[51] Int. Cl.[5] ..... F21V 13/04

[52] U.S. Cl. ..... 362/285; 362/153.1; 362/188; 362/299

[58] Field of Search ..... 362/285, 187, 188, 153.1, 362/805, 431, 255, 297, 298, 300, 327, 338, 277

[56] References Cited

U.S. PATENT DOCUMENTS

| | | | |
|---|---|---|---|
| Re. 21,089 | 5/1939 | Rose . | |
| 563,836 | 7/1896 | Blondel et al. . | |
| 1,521,107 | 12/1924 | Kelsea . | |
| 1,610,127 | 12/1926 | Godley . | |
| 1,916,169 | 6/1933 | Exelmans . | |
| 1,976,163 | 10/1934 | Exelmans . | |
| 2,566,126 | 8/1951 | Franck . | |
| 2,686,255 | 8/1954 | Pascucci . | |
| 2,752,478 | 6/1956 | Clark . | |
| 2,752,479 | 6/1956 | Atwood et al. . | |
| 2,773,174 | 12/1956 | Leida . | |
| 2,777,049 | 1/1957 | Clark . | |
| 3,089,024 | 5/1963 | Odle . | |
| 3,160,350 | 12/1964 | Rex et al. . | |
| 3,179,793 | 4/1965 | Franck . | |
| 3,189,739 | 6/1965 | McPhail . | |
| 3,191,022 | 6/1965 | Wince . | |
| 3,299,263 | 1/1967 | Bjontegard . | |
| 3,334,219 | 8/1967 | Franck et al. . | |
| 3,384,743 | 4/1968 | Little et al. . | |
| 3,398,273 | 8/1968 | Rex et al. . | |
| 3,398,274 | 8/1968 | Rex . | |
| 3,538,324 | 11/1970 | Hankins . | |
| 3,590,238 | 6/1971 | Arens . | |
| 3,704,368 | 11/1972 | Patry . | |
| 3,705,303 | 12/1972 | Willis, Jr. et al. . | |
| 3,950,639 | 4/1976 | Van Steenhoven . | |
| 4,173,037 | 10/1979 | Henderson, Jr. et al. . | |
| 4,214,295 | 7/1980 | Morton . | |
| 4,232,359 | 11/1980 | Leon et al. . | |
| 4,234,912 | 11/1980 | Barnes et al. . | |
| 4,338,654 | 7/1982 | Legothetis . | |
| 4,358,816 | 11/1982 | Soileau . | |
| 4,386,391 | 5/1983 | Gulliksen et al. . | |
| 4,414,612 | 11/1983 | Conforti et al. . | |
| 4,462,067 | 7/1984 | Altman . | |
| 4,530,040 | 7/1985 | Petterson . | |
| 4,533,984 | 8/1985 | Gatton | 362/188 |
| 4,577,260 | 3/1986 | Tysoe . | |
| 4,593,345 | 1/1986 | Beggs . | |
| 4,675,794 | 6/1987 | Fink, Jr. et al. . | |
| 4,683,525 | 7/1987 | Camm . | |
| 4,729,077 | 3/1988 | Gordin et al. . | |
| 4,760,508 | 7/1988 | Russello et al. . | |
| 4,789,923 | 12/1988 | Sales . | |
| 4,823,246 | 4/1989 | Dilouya . | |
| 4,839,781 | 6/1989 | Barnes . | |
| 4,870,548 | 9/1989 | Beachy et al. | 362/431 |
| 5,003,441 | 3/1991 | Crowe et al. | 362/285 |
| 5,017,327 | 5/1991 | Bamber . | |
| 5,029,058 | 7/1991 | Hirose et al. . | |
| 5,055,987 | 10/1991 | Ellson et al. | 362/431 |

FOREIGN PATENT DOCUMENTS

| | | | |
|---|---|---|---|
| 702542 | 1/1941 | Fed. Rep. of Germany | 362/188 |
| 675705 | 2/1930 | France . | |
| 8701209 | 12/1988 | Netherlands . | |

*Primary Examiner*—Richard R. Cole

*Attorney, Agent, or Firm*—Willian Brinks Olds Hofer Gilson & Lione

[57] ABSTRACT

An adjustable outdoor light fixture powered by an electrical current provided by wire leads capable of producing a variable light beam distribution pattern comprising, a housing having an outside surface and an inside surface and defining a cavity with an open face, a reflector supported within the cavity of the housing, a lens covering the open face of the housing, the lens movable relative to the reflector, and a light source connected to the leads adapted to be attached to the lens within the cavity of the housing whereby the lens and the light source are movable relative to the reflector in order to produce a variable light beam distribution pattern. Also included is a reflex optics reflector for an outdoor light fixture that improves transmittance of light from the fixture.

13 Claims, 2 Drawing Sheets

12
28
32
34
36
38
30
40
42
44
46
48
50
52
54
56
57
58
60
62
64
65
66
68
70
72
74
76
78

OUTDOOR VARIABLE FOCUS LIGHT FIXTURE

FIELD OF THE INVENTION

The invention relates to an outdoor lighting fixture apparatus. In particular, the invention relates to a low voltage outdoor light fixture capable of altering the width of the light beam cast by the apparatus.

BACKGROUND OF THE INVENTION

Outdoor light fixtures have been known for many years. One type of outdoor light fixture is an outdoor spot light. An outdoor spotlight produces a concentrated narrow beam of light used for illumination of a small area. Another type of outdoor light fixture is an outdoor flood light. An outdoor flood light produces a larger, less concentrated beam of light used for illumination of a larger area. In the past, conventional outdoor lighting fixtures were designed and constructed to provide a desired light distribution for a particular application. For example, a landscaper or homeowner would have to determine the specific beam width required for an application and purchase an outdoor light fixture specifically designed for this application. Thus, these outdoor light fixtures offered no versatility for different uses.

Some outdoor lights are variable focus, i.e. they can be adjusted by the user for either a narrow beam, (e.g. spot lighting) or a wide beam (e.g. flood lighting). An example of a variable focus outdoor light fixture is the Intermatic Optimatic. The Optimatic variable focus outdoor light has a housing with a lens mounted therein. A substantially parabolic reflector is mounted within the housing. A lamp holder for supporting an electrical lamp is mounted within an aperture centrally located on the reflector. The lamp holder is connected to a turn button that allows for movement of the light source relative to the reflector. By movement of the light source relative to the lens, the light beam output may be varied depending the width of the beam necessary for a desired application.

Another example of a variable focus outdoor light fixture is disclosed in U.S. Pat. No. 4,870,548 issued to Beachy. In this patent, an outdoor light fixture capable of producing a light beam having an adjustable width is disclosed. A housing supports a reflector with an aperture centrally located therein. A light bulb is inserted within the aperture. A rotatable focus ring has an inner surface that holds the reflector. When the focus ring is rotated relative to the housing, the reflector moves axially relative to a light bulb. The rearward or forward positioning of the reflector produces a light beam of varying width.

While variable focus outdoor light fixtures are more versatile than fixed focus fixtures, the known mechanisms to produce a variable focus light fixture make them relatively more complex than fixed focus fixtures thus adding to the cost of the product. Also, previous variable focus mechanisms may be difficult to protect from moisture and operate under outdoor weather conditions. In addition, prior art light fixtures did not allow for easy bulb or lens replacement. Furthermore, the placement of the light bulb within the reflector may result in an unnecessary energy dissipation thereby reducing the efficiency of the fixture.

Another disadvantage of the prior outdoor light fixtures was that the use of a standard vacuum metallized plastic or aluminum reflector limited the optimum light output from the fixture. Furthermore, a vacuum metallized reflector requires costly manufacturing processes.

SUMMARY OF THE INVENTION

An outdoor light fixture has been invented that is an advance over the prior devices. According to a first aspect of the invention, an improved outdoor variable focus light fixture has been invented that includes an outdoor light fixture powered by an electrical current. The electrical current is provided to an electrical supply source. The variable focus light fixture comprises a housing having an outside surface and an inside surface and defining a cavity with an open face. A reflector is supported within the cavity of the housing. A lens covers the open face of the housing and is movable relative to the reflector. A light source is adapted to be attached to the lens within the cavity of the housing whereby the lens and the light source are movable relative to the reflector in order to produce a variable light beam distribution pattern.

According to another aspect of the invention, a reflex optics reflector is positioned within the light fixture assembly to reflect light projected from the light source. The light fixture comprises a housing having an outside surface and an inside surface and defining a cavity with an open face. A reflex optics reflector that allows for improved transmittance of light from the light fixture is supported within the cavity of the housing. A light source is adapted to be attached to the lens and positioned within the cavity of the housing.

It is an advantage of this invention to provide an adjustable focus fixture that is easy to manufacture and assemble. Another advantage of this invention is to provide an adjustable focus light fixture with improved water-resistant properties. It is also an advantage of this invention to provide a light source attached to a removable lens allowing for easy bulb replacement. Another advantage of this invention is provide a light fixture with a lens suitably mounted for easy replacement with other lenses of varying types, colors, etc.

It is an advantage of this invention to provide an improved reflector that increases the light transmitted from the fixture. It is further an advantage of the of this invention to provide a more cost efficient reflector.

The advantages of the invention as well as the invention itself, will be best understood by reference to the following drawings.

DETAILED DESCRIPTION OF THE PREFERRED EMBODIMENTS

Figure 1:
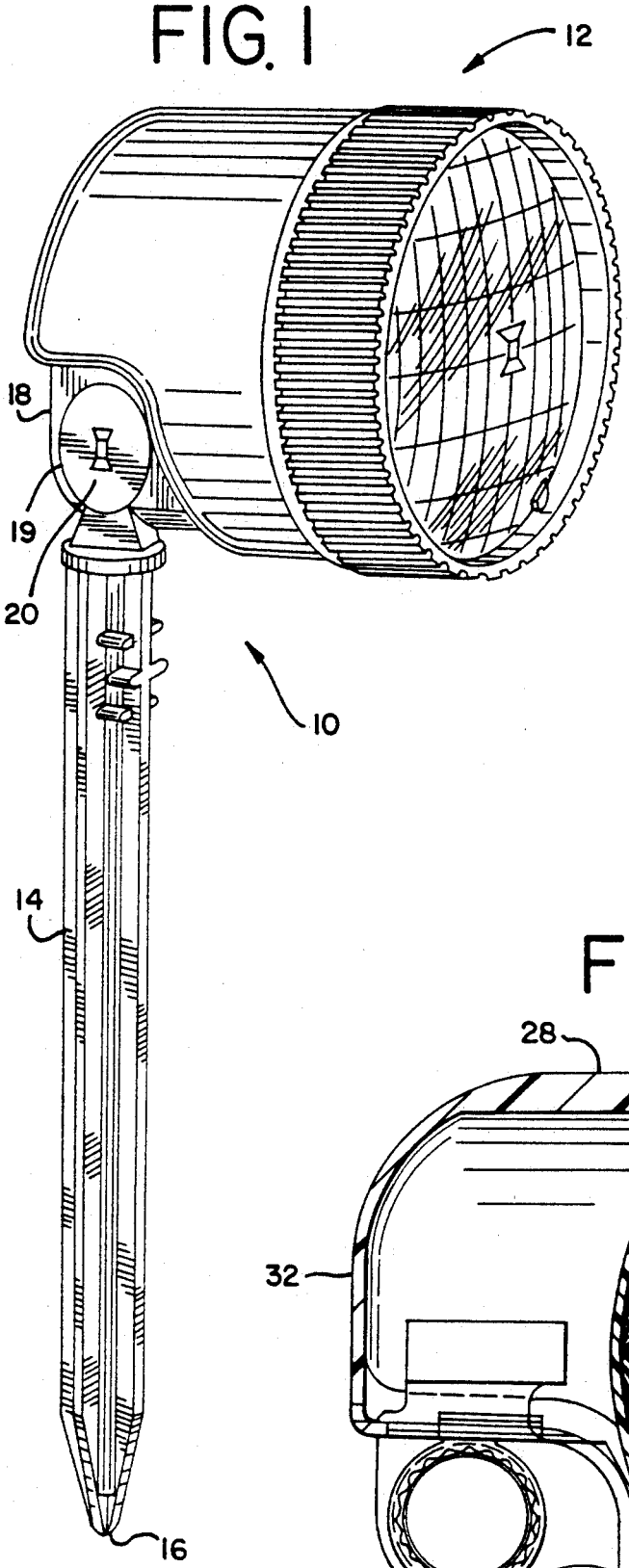
FIG. 1 illustrates a perspective diagrammatic view of an adjustable focus outdoor light fixture according to an embodiment of this invention.

The remaining portion of the specification will describe preferred embodiments of the invention when read in conjunction with the attached drawings, in which like reference characters throughout the several views are designated with like reference numerals.

FIG. 1 illustrates a perspective view of a variable focus outdoor light fixture 10 in accordance with an embodiment of the invention. The light fixture 10 includes a housing 12 and a ground engaging element preferably in the form of ground stake 14. As will be explained below, the housing 12 is fixedly supported on the ground stake 14 through an interlocking mechanism. However, the housing 12 could be supported by other mechanisms, such as surface mounting brackets to facilitate positioning the fixture on decks, porches, railings, trees or surfaces other than the ground, without departing from the spirit of this invention.

The ground stake 14 has a point 16 for insertion into the ground. Preferably, the ground stake 14 has a length of approximately 18 inches in order to provide a secure ground mount. The preferred material for the ground stake is a plastic material such as polypropylene.

In this embodiment, the ground stake 14 is pivotally connected to the housing 12. The ground stake 14 is connected to the housing 12 through a detachable yoke 18. The yoke 18 defines an aperture 19 and a small aperture (not shown) through which an electrical wire may pass. The aperture 19 is sized to form a snap-fit relationship with a cylindrical head 20 of the stake 14. The cylindrical head 20 has a ratchet surface (not shown) that engages a similarly shaped ratchet surface (not shown) on the inside of the yoke 18. The two ratchet surfaces mate to provide a frictional fit thereby allowing for fixing the housing 12 at various positions in the azimuthal plane. The housing 12 may be repositioned in the azimuthal plane by manually moving the housing 12 so that the frictional fit of the cylindrical head 20 and the yoke 18 is overcome in order to move the housing 12 in the azimuthal plane.

Figure 2:
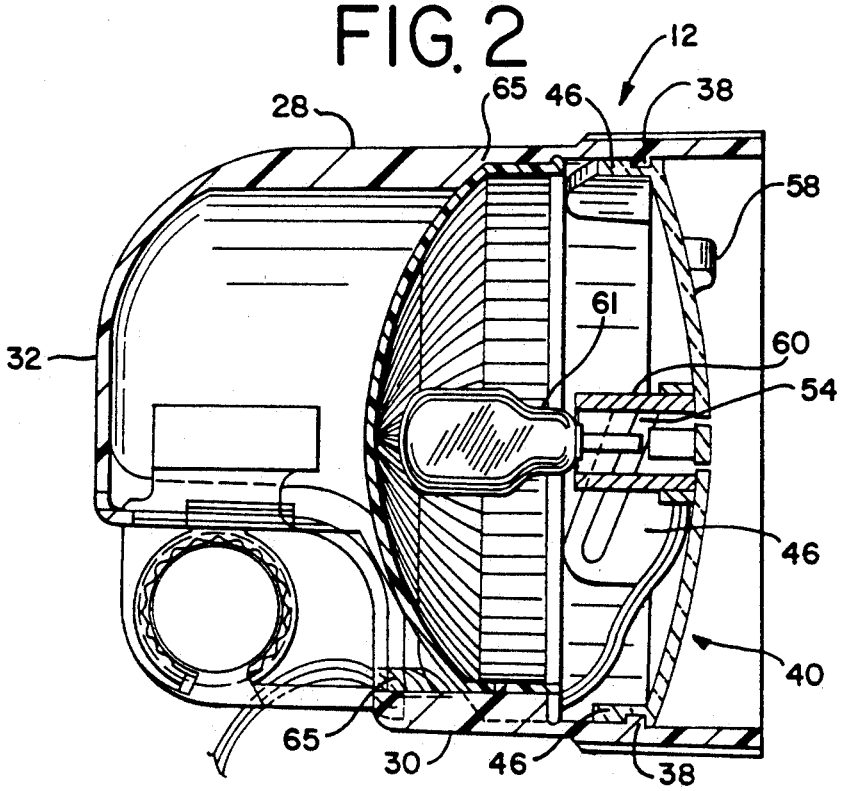
FIG. 2 is a sectional view taken along the lines 2—2 of FIG. 1.
Figures 3, 4:
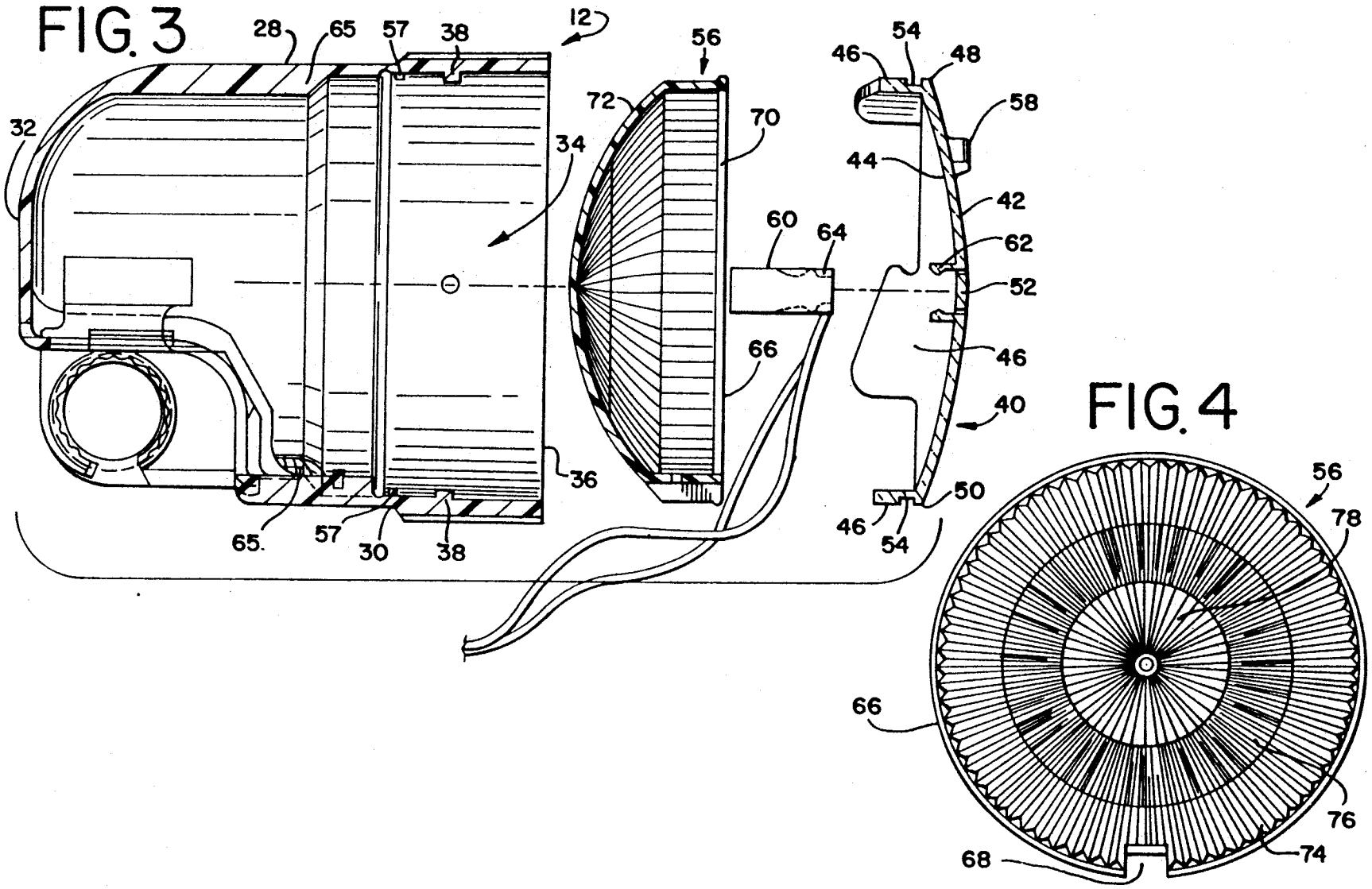
FIG. 3 is perspective view of the embodiment of FIG. 2 in an exploded relationship.
FIG. 4 is a perspective view of the reflector of FIGS. 1-3.

As better shown in FIGS. 2–3, the housing 12 has a substantially cylindrical shape. The housing 12 has an inside surface defining a top wall 28, a bottom wall 30, two side walls (not shown) and a back wall 32. The housing further defines a cavity 34 and an open face 36. The housing 12 has approximate dimensions of 4 inches in length by 3 inches in width by 3 inches in height. Pins 38 are located on the inside surface of the housing 12. In this embodiment, four pins are provided. The pins are approximately ⅛ of an inch in diameter and extend 3/32 of an inch toward the inside axis of the housing 12. The pins 38 extend axially from the top wall 28, the bottom wall 30 and the two side walls of the inside surface of the housing 12.

The open face 36 of the housing 12 has a lens 40 mounted therein. The lens 40 is received in the front of the housing 12 by a slide fit or the like. The lens 40 is substantially dish-shaped and has a radius of approximately 1.5 inches. The lens 40 has an outside surface 42 and an inside surface 44. The inside surface 44 of the lens comprises a series of small hexagonal shaped optical elements (not shown). Each small optical element has a length of approximately 0.1 inches. The lens 40 is substantially transparent. In a preferred embodiment, the lens 40 is made of a plastic material, such as polycarbonate or acrylic. Furthermore, lenses made from plastics of varying color may be used in order to provide light beams transmitted from the assembly of varying colors.

Cams 46 extend substantially rearwardly from the top side 48, the bottom side 50 and the two side edges 52 (one not shown) from the lens 40. The cams 46 are adapted to cooperate with the pins 38. Accordingly, in this embodiment, there are four pins provided. The four cams 46 each have a groove 54 of substantial pitch. The pitch of the grooves 54 is determined by balancing the competing considerations requiring axial movement of the lens 40, but without over-extending the wire leads supplying power to the fixture. As better explained below, the groove 54, in a preferred embodiment will angle approximately 20 degrees off of a tangential line passing through the cam 46. The grooves 54 are sized and configured to receive the four pins 38 on the inside surface of the housing 12. As further described below, the grooves 54 of the cams 46 engage the axially extending pins 38 from the housing 12. By manually rotating the lens 40, the lens 40 is forced forward or rearward, as the case may be, because of the rotation of the lens 40. In rotation, the pins 38 slide through the grooves 54 in order to impart axial movement to the lens 40 relative to a reflector 56.

Two tabs 58 (one shown) are located on the outside surface of the lens 40. The tabs 58 are readily accessible from the front of the assembly to allow for the manual rotation of the lens assembly 40. A lamp holder 60 with an attached bulb 61 is connected to the inside surface of the lens 40. The location of lamp holder 60 on the lens 40 allows easy placement of the bulb 61. The placement of the lamp holder 60 improves the light transmittal from the fixture while making the fixture easier to manufacture and assemble. Furthermore, the placement of the lamp holder 60 on the lens 40 places the lamp holder 60 further from the base of housing 12 where water may accumulate.

In a preferred assembly, two rigid prongs (not shown) and two flexible prongs 62 detachably connect a lamp holder 60 to the lens 40. (Alternatively, lens 40 and the lamp holder 60 may be integrally formed.) The two prongs 62 extend substantially axially from a centrally located position on the inside surface 44 of the lens 40. Two corresponding prongs 64 on the lamp holder 60 engage the prongs 62 in order to secure the lamp holder 60 to the lens 40. The two prongs 64 are sized to receive the prongs 62 in a snap-fit relationship. Preferably, the lamp holder 60 is made from a clear plastic material, such as polycarbonate, in order to minimize shadowing.

The lamp holder 60 contains two leads or wires within a socket of the lamp holder 60. The leads may comprise a conductive material such as brass, copper, silver, etc. The leads (not shown) are connected to electrical wires. The wires run through the lamp holder 60 and pass through the yoke 18. In a preferred embodiment, the leads are insulated with a sheath of clear plastic material such as 18 PVC clear plastic coating in order to minimize shadowing. An 18 gauge wire is preferred for the leads. Electrical, current is provided through the leads to the bulb 61. The wires are preferably connected to a low voltage supply capable of providing about 12 volts.

A bulb 61 is placed in the lamp holder 60 and in conductive contact with the leads in order to provide a light source. The bulb 61 is connected to the leads so as to fix the bulb 61 relative to the inside surface 44 of the lens 40. In this embodiment, a T-5 wedge base incandescent bulb is preferred as the light source although other bulbs may be used such as a halogen bulb. The preferred power level for the bulb 61 is approximately 4 watts although other power levels such as 7 watts may be used, depending on the particular application.

In a preferred embodiment, the reflector 56 is mounted in a snap-fit relationship with the housing 12.

The reflector 56 is held in place inside the housing 12 by pins 57. The pins 57 are sized to allow the reflector 56 to pass over the pins during assembly of the device, but are capable of holding the reflector 56 securely within the back of the housing 12. The reflector 56 is also held in place by the angled ribs 65 which abut the reflector 56 when secured by the pins 57. The reflector 56 has a parabolic contour with a radius of approximately 1.5 inches. Preferably, the reflector 56 has a focal length of approximately 0.8 inches.

In a preferred embodiment, the reflector 56 is made of a molded plastics such as polycarbonate or acrylic. The reflector 56 has a plurality of prismatic zones, (hereinafter, a "reflex optics" reflector), as described in more detail below. However, the reflector 56 may also be formed of conventional materials, such as from various metallized plastics such as metallized polycarbonate. The outside perimeter 66 of the reflector 56 has a cutout 68 located to correspond to the bottom wall 30 of the housing 12. The cutout 68 allows the electrical wires that supply current to the bulb 61 to pass through the reflector 56 and through the yoke 18 of the housing 12 to the electrical supply.

The light fixture is assembled by placing the wire leads with the attached lamp holder through an aperture in the back of the housing 12. The yoke 18 is detachably mounted in the back of the housing 12 with the wire leads passing through a small aperture in the yoke 18. The cylindrical head 20 of the stake 14 is accepted within the aperture 19 of the yoke 18. The cylindrical head 20 is frictionally engaged by the yoke 18 in such a manner as to allow the housing 12 to be moved in the azimuthal plane.

The reflector 56 is placed in the back of the housing 12. The pins 57 engage the reflector 56 to securely hold the reflector 56 in place. Further, the reflector 56 is positioned to allow the leads to pass through the cutout 68.

The lamp holder 60 is detachably fixed to the lens 40. The flexible prongs 62 of the lens 40 engage the corresponding prongs 64 of the lamp holder 60 to attach the lamp holder 60 to the lens 40. A bulb 61 is placed in the lamp holder 60 to provide illumination. The use of a detachable lamp holder 60 is preferred because the lens can be readily replaced or exchanged, for example if the lens is damaged or if a different lens is desired, such as a color tinted lens.

The lens 40 is placed inside the housing 12 whereupon the groves 54 engage the pins 38 by turning the lens 40 counter-clockwise. By turning the lens counter-clockwise, the pins 38 overcome a first ridge on the first end of the groove 54 to be slidably supported within the groove 54. By continuing to turn counter-clockwise, the pins 38 will pass over a second ridge on the opposite end of the groove 54 to allow for the lens 40 and the lamp holder 60 to be removed from the housing 12. Thereby, the lens 40 or the bulb 61 may be easily replaced.

In operation, the output beam is adjusted by manually rotating the lens 40 by using the tabs 58. The rotation of the lens 40 clockwise or counterclockwise will result in the respective rearward or forward motion of the bulb 61 as carried by the lamp holder 60 and the lens 40. Preferably, by twisting the lens approximately 25° the bulb will be carried across its full course of axial travel. In the present preferred embodiment, the rotation of the lens through an angle of approximately 25° will move the light source approximately 0.3 inches toward or away from the reflector 56. Thus, the bulb 61 and the lens 40 are moved relative to the fixed reflector 56 thereby adjusting the focus of the output beam. When the bulb 61 is placed near the focus of the reflector 56, a narrow beam is reflected from the reflector 56. This position is illustrated in FIG. 2. In contrast, when the bulb 61 is displaced from the focus of the reflector 56, a wide diverging beam is reflected.

It should be recognized that other mechanisms for moving the bulb 61 may be used. For example, a turn button, slide, ratchet gear, or other means may be utilized to move the lens/light source assembly relative to the reflector 56.

Although the above-described embodiment discloses a light source mounted on a lens in a variable focus light fixture, the light source may be mounted on the lens of a fixed focus light fixture.

In a preferred embodiment, as best shown in FIG. 4, and as shown in schematic in FIGS. 2–3, a reflex optics reflector 56 is used with a variable focus light fixture. A reflex optics reflector is described in pending application Ser. No. 07/373,941 filed on Jun. 26, 1989 and in U.S. Pat. No. 4,839,781 issued on Sep. 26, 1989 to Barnes et al., disclosures of which are specifically incorporated herein by reference. The use of a reflex optics reflector 56 is preferred because of the greater reflectance of the assembly, ease of manufacturing, durability and strength. The reflex optics reflector 56 allows for light incident upon the center of the reflector to be reflected out of the housing 12. Thereby, light incident upon the center of the reflex optics reflector 56 may be transmitted from the housing 12.

In a preferred embodiment, the reflex optics reflector 56 is adapted to reflect light around the bulb 61 and lamp holder 60, thereby increasing the amount of light reflected. This feature can readily be provided by a parabolic reflex optics reflector 56, but could not readily be provided in a conventional parabolic reflector without significant modification of the parabolic geometry.

The reflex optics reflector 56 has an inside surface 70 and an outside surface 72. The reflector 56 has a series of three sectional zones 74, 76 and 78. Each sectional zone has series of vertically aligned prisms. The prisms each have a width of approximately 0.1 inches. In zone 74, seventy-two prisms are located. Each prism in zone 74 represents a 5 degree angle relative to the center of the reflector 56. In zone 76, forty-eight prisms are located. Each prism in zone 76 represents a 7.5 degree angle relative to the center of the reflector 56. In zone 78, twenty-four prisms are located. Each prism in zone 78 represents a 15 degree angle relative to the center of the reflector 56. Again, preferably the reflector 56 has a radius of approximately 1.5 inches. As described above, the reflector 56 may be formed from various plastics such as polycarbonate, acrylic, etc.

Although the above described embodiment discloses use of a reflex optics reflector 56 in a variable focus light fixture with a bulb 61 mounted on the lens 45, the reflex optics reflector 56 may be used in a fixed focus fixture with a bulb mounted on the lens.

It should also recognized that the above described light fixtures may be powered by means other than stepped down house current. For example, the power supply could be a separate battery source or a solar panel.

The present embodiments are illustrative and not restrictive. The scope of the invention is indicated by the claims rather than by the foregoing description. The invention may be embodied in other specific forms without departing from the spirit of the invention. Accordingly, all changes which come within the meaning and range of the equivalents of the claims are intended to be embraced therein.

What is claimed is:

1. An adjustable outdoor light fixture powered by an electrical current provided by wire leads connected to an electrical supply source and capable of producing a variable light beam distribution pattern comprising:

(a) a housing having an outside surface and an inside surface and defining a cavity with an open face;

(b) a reflector supported within the cavity of the housing;

(c) a lens covering the open face of the housing, the lens movable relative to the reflector; and (d) a light source connected to the leads and adapted to be attached to the lens within the cavity of the housing whereby the lens and the light source are movable relative to the reflector in order to produce a variable light beam distribution pattern.

2. The light fixture according to claim 1 wherein the reflector is a reflex optics reflector.

3. The light fixture according to claim 1 wherein the reflector is formed from a substantially transparent material.

4. The light fixture according to claim 1 wherein the reflector includes a series of prisms along one surface of the reflector opposite the light source.

5. The light fixture according to claim 4 wherein the reflector comprises a series of sectional zones consisting of substantially vertically aligned prisms.

6. The light fixture according to claim 1 wherein the lens includes a cam with a groove and the housing includes a peg that engages the groove whereby rotation of the lens produces an axial movement of the lens and the light source relative to the reflector.

7. The light fixture according to claim 1 wherein the lens further includes a tab to facilitate rotation whereby the lens and the light source may be moved relative to the reflector.

8. An outdoor light fixture powered by an electrical current provided by wire leads connected to an electrical supply source comprising:

(a) a housing having an outside surface and an inside surface and defining a cavity with an open face;

(b) a reflex optics reflector supported within the cavity of the housing;

(c) a lens covering the open face of the housing; and (d) a light source connected to the electrical leads adapted to be attached to the lens within the cavity of the housing.

9. The light fixture according to claim 8 wherein the lens is movable with respect to the reflector.

10. The light fixture according to claim 8 wherein the lens includes a cam with a groove and the housing includes a peg that engages the groove whereby rotation of the lens produces an axial movement of the lens and the light source relative to the reflector.

11. The light fixture according to claim 8 wherein the lens further includes a tab to facilitate rotation whereby the lens and the light source may be moved relative to the reflector.

12. The light fixture according to claim 8 wherein the reflector comprises a translucent material with a series of prisms capable of reflecting light along one surface of the reflector opposite the light source.

13. The light fixture according to claim 12 wherein the reflector comprises a series of sectional zones consisting of substantially vertically aligned prisms.

* * * * *

UNITED STATES PATENT AND TRADEMARK OFFICE

CERTIFICATE OF CORRECTION

PATENT NO. : 5,249,109
DATED : September 28, 1993
INVENTOR(S) : John F. Denison et al.

It is certified that error appears in the above-indentified patent and that said Letters Patent is hereby corrected as shown below:

In column 1, line 40, after "depending" insert --on--.

In column 2, line 39, after "is" insert --to--.

In column 2, line 44, delete "of the".

In column 4, line 53, after "Electrical" delete ",".

Signed and Sealed this

Eleventh Day of April, 1995

Bruce Lehman

*Attest:*

BRUCE LEHMAN

*Attesting Officer*

*Commissioner of Patents and Trademarks*